United States Patent [19]

Tararine et al.

[11] 4,068,393

[45] Jan. 17, 1978

[54] PROJECTILE FIRING TRAINING METHOD AND DEVICE

[76] Inventors: Vsevolod Tararine, 6, rue Daumier, Paris, France, 75016; Jacques Hubert, 7, rue Parmentier, Asnieres, France, 92600

[21] Appl. No.: 712,830

[22] Filed: Aug. 9, 1976

Related U.S. Application Data

[63] Continuation-in-part of Ser. No. 605,554, Aug. 18, 1975, abandoned, which is a continuation of Ser. No. 517,770, Oct. 24, 1974, abandoned, which is a continuation of Ser. No. 374,079, June 27, 1973, abandoned.

[30] Foreign Application Priority Data

June 27, 1972 France ..... 72.23118

[51] Int. Cl.[2] ..... F41G 3/26

[52] U.S. Cl. ..... 35/25

[58] Field of Search ..... 35/25; 89/41 L, 41 TV, 89/134

[56] References Cited

U.S. PATENT DOCUMENTS

| | | | |
|---|---|---|---|
| 3,575,085 | 4/1971 | McAdams, Jr. | 89/41 L |
| 3,608,212 | 9/1971 | Lenneryd et al. | 35/25 |
| 3,618,456 | 11/1971 | Mindel | 89/134 |
| 3,965,582 | 6/1976 | von Bennigsen | 35/25 |

*Primary Examiner*—William H. Grieb

*Attorney, Agent, or Firm*—Holman & Stern

[57] ABSTRACT

The invention is concerned with the techniques of firing simulation. Its main subject is a method of and device for firing training, in which optical simulation of firing as a function of at least the firer's aim and of reference data comprising at least a reference line of sight and a target distance, is characterized by the fact that account is taken in the simulation of prerecorded terrain data defining at least three ground planes perpendicular to the line of sight, vertical plane containing the said three ground planes being located around the target, in front of the target, and behind the target, with respect to the firer.

15 Claims, 14 Drawing Figures

PROJECTILE FIRING TRAINING METHOD AND DEVICE

This application is a continuation-in-part of prior application Ser. No. 605,554 filed Aug. 18, 1975, which in turn was a Rule 60 continuation of Ser. No. 517,770 filed Oct. 24, 1974, which in turn was a Rule 60 continuation of Ser. No. 374,079 filed June 27, 1973 all now abandoned.

For the training of gunners or gun crews operating guns firing ballistic projectiles against land or sea targets, use is already made of simulated gunnery techniques, whereby optical simulation of firing is provided in an aiming device aimed by the gunner at a model or real target and, if required, in a second sight provided for an instructor. Conventional simulation consists in superimposing on the landscape seen in the aiming device a luminous spot, which indicates the trajectory of the simulated projectile tracer or flare and the simulated detonation of the projectile after an estimated interval required to reach the target.

This type of simulation, which simply indicates the point at which the simulated projectile passes through a plane, which is generally vertical, containing the target and perpendicular to the line of sight, is not satisfactory, since if the target is not hit, it does not allow the necessary fire corrections to be made, which is reality are based on the observation, often difficult but essential, of the points of impact of the fired projectiles with the ground.

In order to provide more efficient training of gunners and/or gun crews, without spending ammunition, it became necessary to improve the realism of gunfire simulation by introducing into the simulator the possibility of observing target hits and the impacts of misses around the target.

To this end, the method of gunnery training according to the invention provides for associating with a conventional gunnery simulator a system for simulating the terrain, whose characteristics are stored in the memory of a computer before simulated firing.

In the method according to the invention, optical simulation is provided as a function of at least the gunner's aim and reference data comprising at least a reference line of sight and target distance, and allowance is made in the simulation for prerecorded terrain data defining at least one ground plane distinct from the firing plane and from the plane perpendicular to the line of sight at the said target distance.

If, as is most frequently the case for land or naval gunnery, the line of sight is virtually horizontal, the terrain data define preferably at least one ground plane, which does not contain the vertical through the target. Such a plane is notably the plane perpendicular to the firing plane passing through the visible base of the target, but preferably the recorded terrain data define at least three ground planes, located around the target, in front of the target, and behind the target, with respect to the gunner.

Thus, in a preferred embodiment of the invention, the method of gunnery training comprises the steps of simulating the firing of a projectile from a gun up to the point of impact of the fired projectile by optically representing the trajectory of said projectile as a function of the aiming of the gun and of reference data which includes a reference line of sight from the gun to the target and the distance to the target from the gun; and wherein said point of impact of said projectile is defined by its simulated intersection with simulated terrain data which defines at least three ground planes perpendicular to the vertical plane containing the line of sight, said ground planes located respectively around the target, in front of the target, and behind the target, with respect to said gun.

By selecting terrain data for best simulation of the terrain close to the target, the simulated point of impact with the ground can be defined by the intersection of the simulated projectile trajectory with the said ground planes away from the target, and, if required, it is possible to indicate differently in the simulation a simulated impact on the ground and a simulated impact on the target, to distinguish between an impact with the ground in front of the target and an impact behind the target, and to introduce in the simulation various special predetermined effects, which can be selected as a function of the point of impact, but also as a function of other data characterizing firing conditions, the terrain or the target and likely to affect observation of the impact or the trajectory of a simulated projectile tracer.

The invention also covers a device for applying the gunnery training method, consisting essentially of at least an optical unit, a computer, and a control unit.

The characteristics of this device, as well as other embodiments of the invention, in the preferred modes of its practical application will appear when reading the following description of examples which are not exhaustive. This description refers to FIGS. 1 to 12 attached, in which.

Figure 3A:
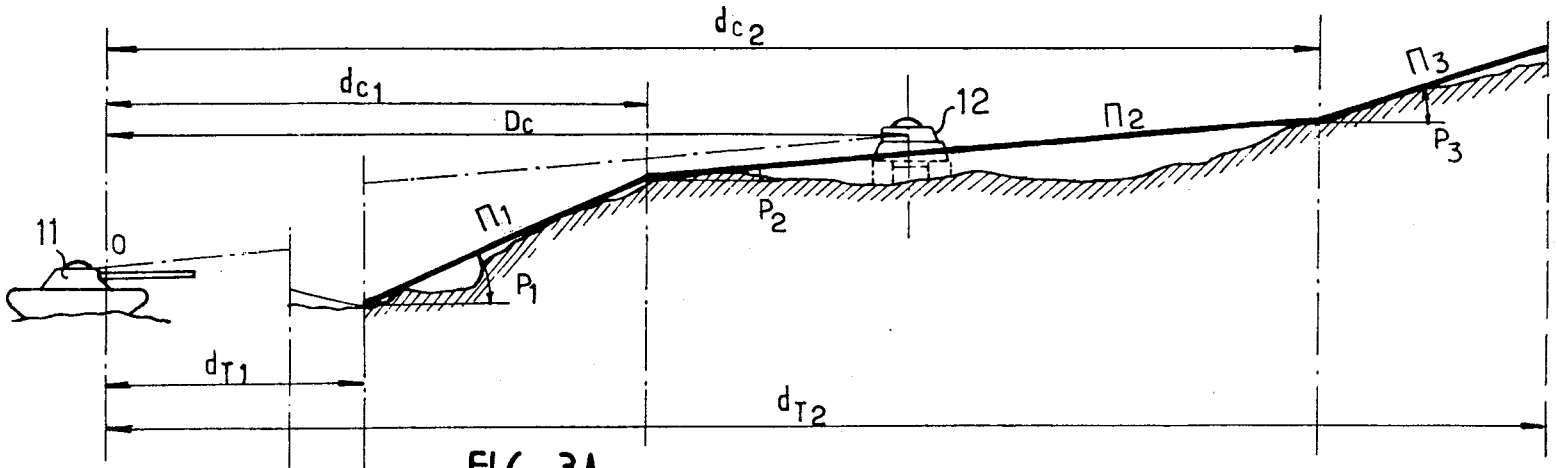
FIGS. 3A and 3B illustrate terrain definition by three ground planes.
Figure 3B:
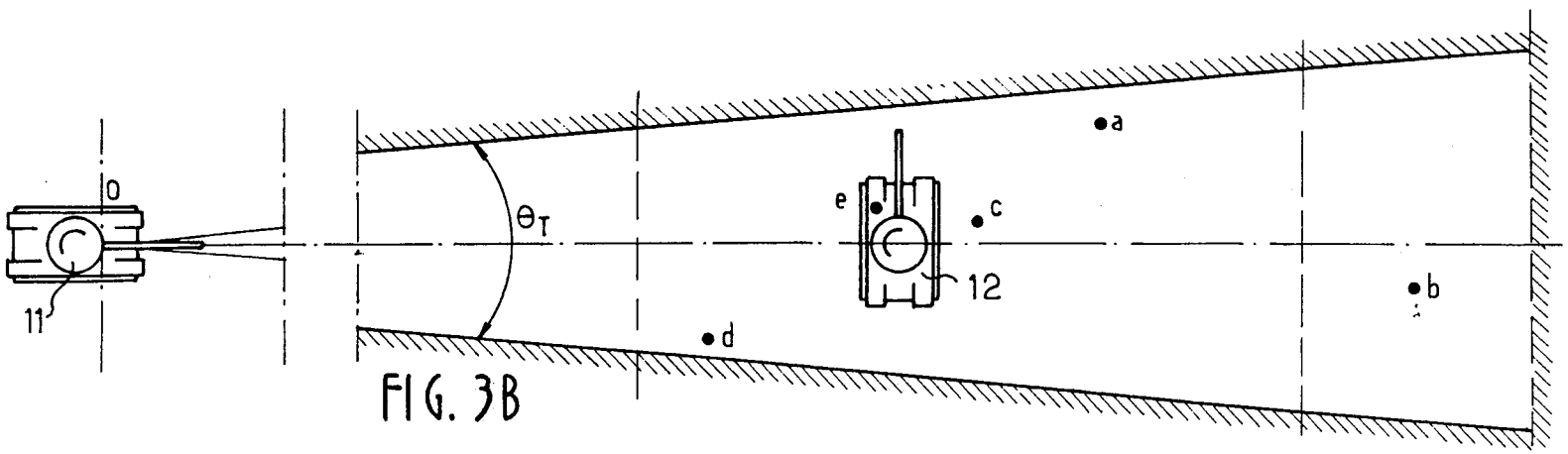
Figure 5:
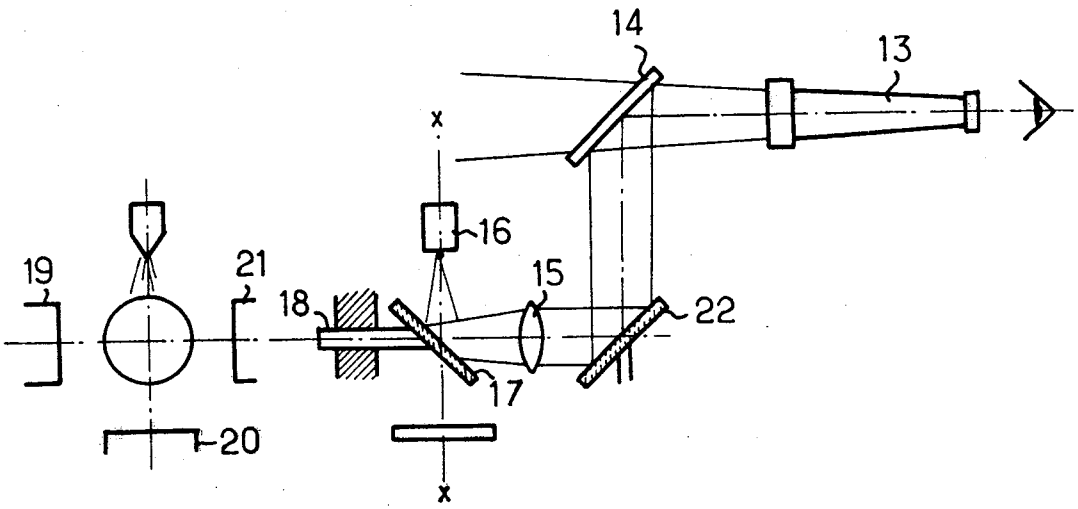
Figure 4:
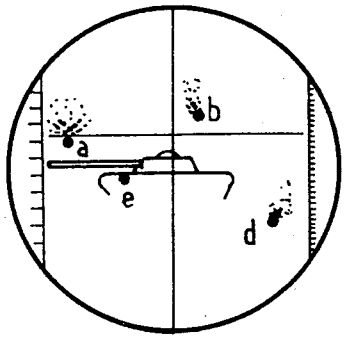
Figure 6A:
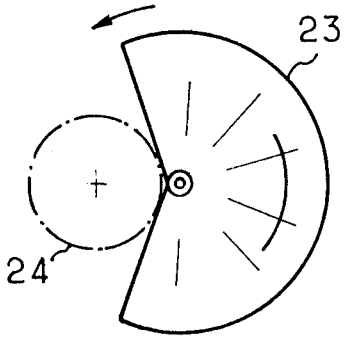
Figure 6B:
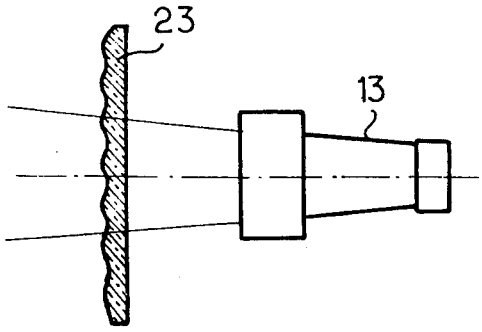
Figure 9:
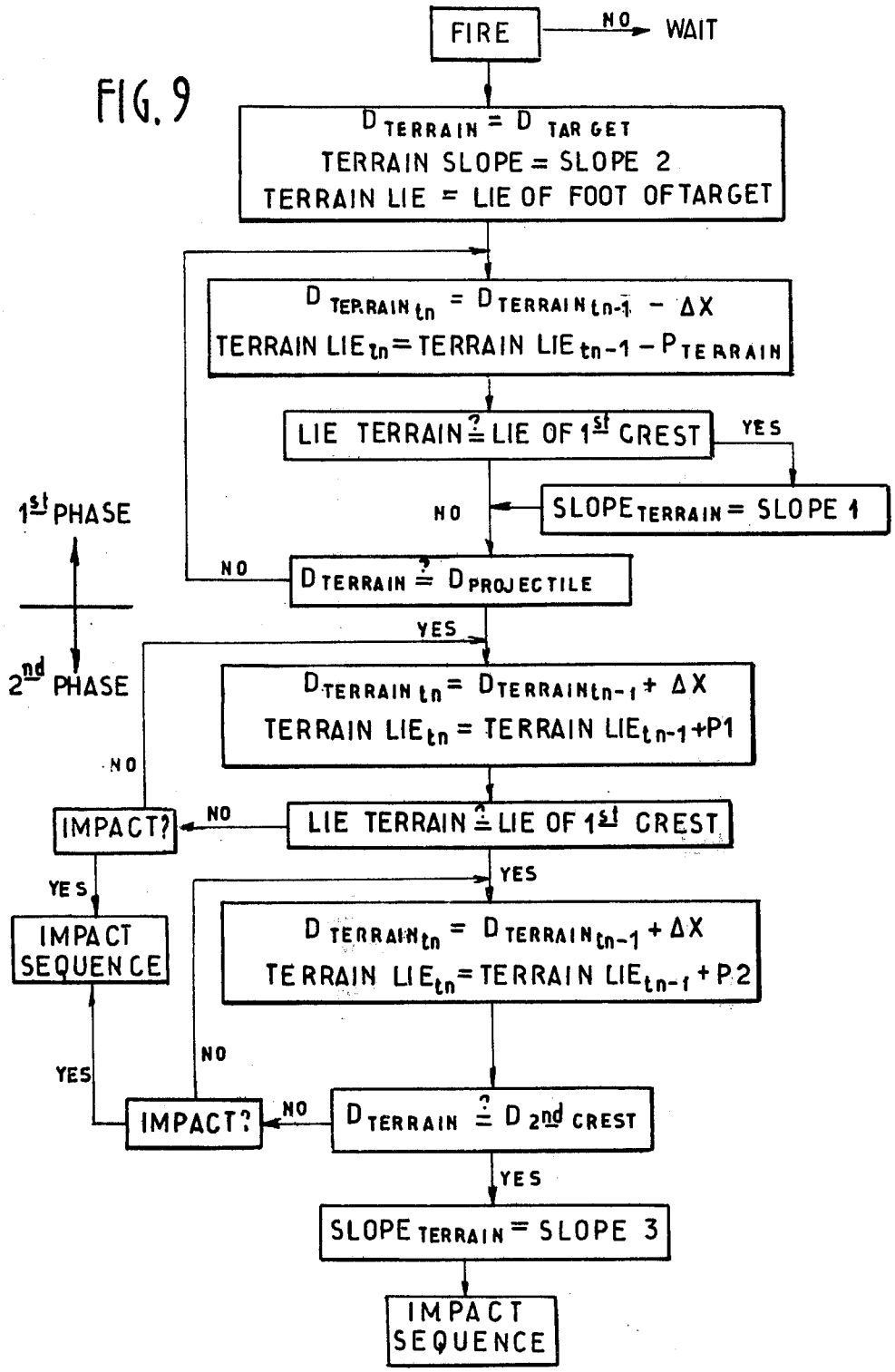
Figure 10:
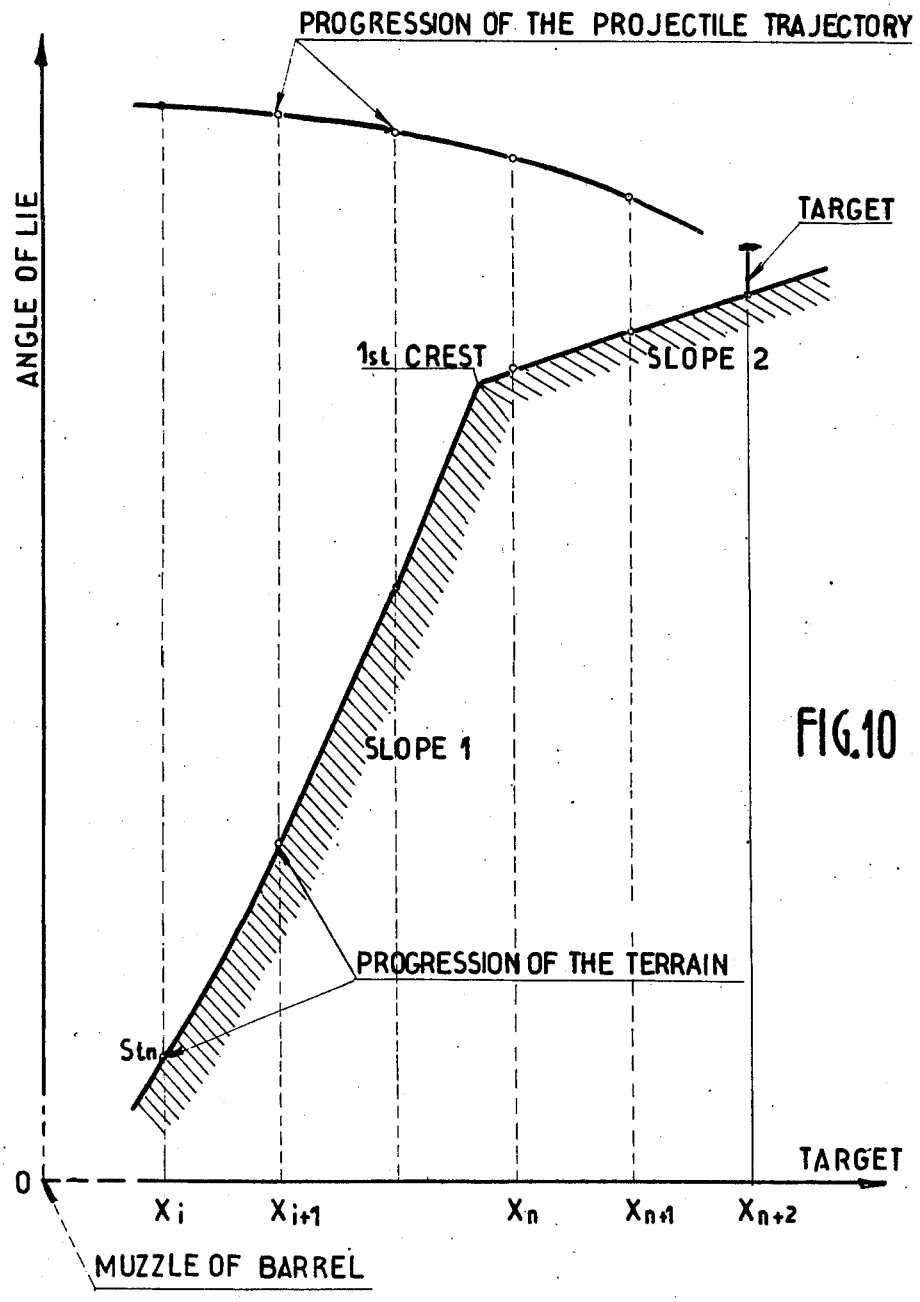
Figure 11:
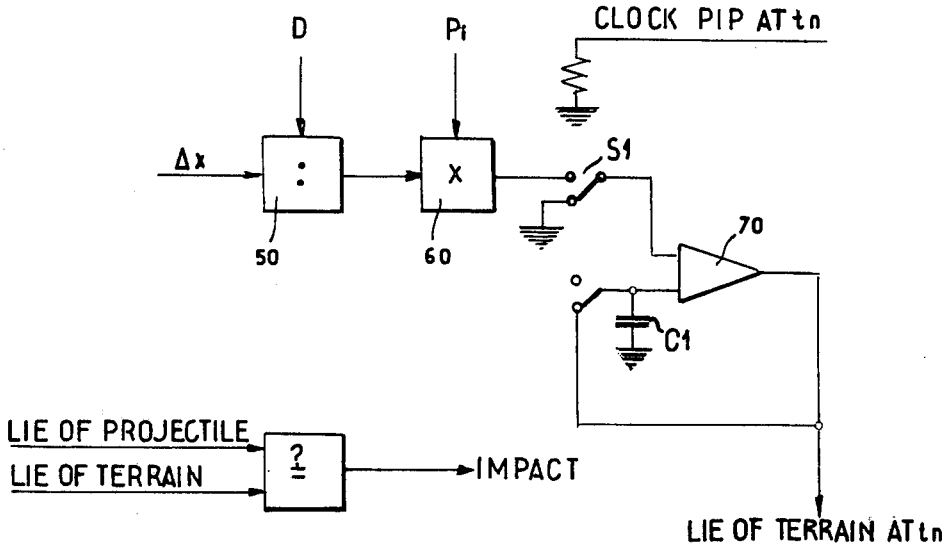
Figure 12:
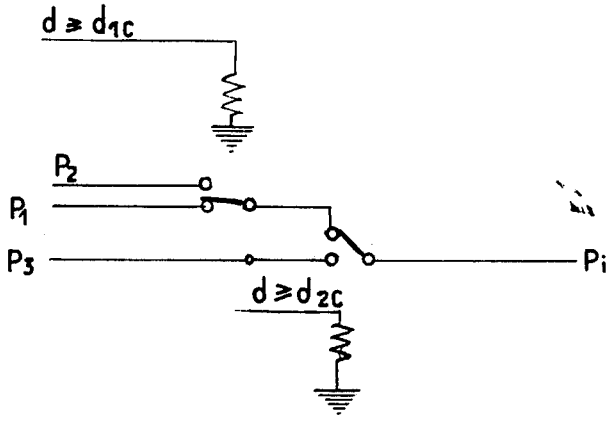

FIG. 4, in conjunction with FIGS. 3A and 3B illustrate the simulation of different impacts in the gunner's aiming device;

FIG. 5 shows an optical unit used in a preferred application of the device;

FIGS. 6A, 6B 7 and 8 schematically represent particular devices for simulating special effects;

FIG. 9 is a flow chart of a computer program helpful in determining the point of intersection of the simulated projectile with the simulated terrain in accordance with the present invention;

FIG. 10 is a schematic representation of the simulated terrain and projectile trajectory helpful in understanding the programmed operation depicted in FIG. 9;

FIGS. 11 and 12 are schematic circuit diagrams which serve as examples of typical functional blocks useful in performing some of the operations incident to the present inventive technique.

Figure 1:
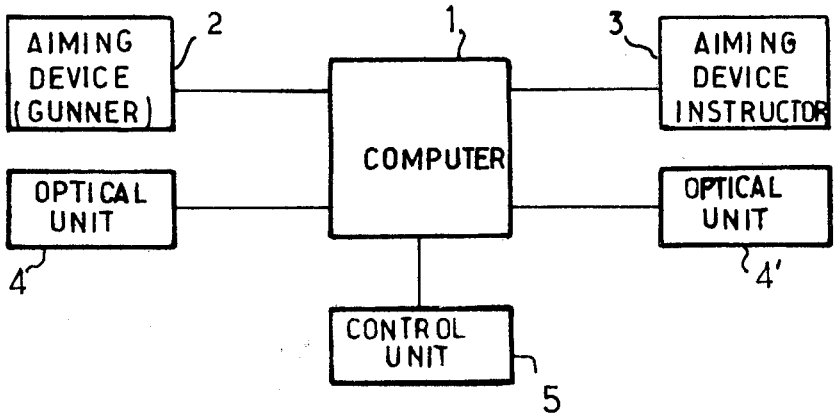
FIG. 1 shows schematically the main components of a gunnery training device.

The device schematically illustrated by FIG. 1 consists essentially of a computer 1, an aiming device 2 for the gunner, an optical unit 4 associated with aiming device 2, and a control unit 5. Other aiming devices can be provided for one or more of the other members of the gun crew. An optical unit similar to optical unit 4 is associated with each of these aiming devices. The device shown in FIG. 1 includes an aiming device 3 for an instructor, with an associated optical unit 4'.

Each optical unit projects a luminous spot controlled in brightness and angular position by electrical signals produced by the computer, through its associated aiming device, superimposing this spot on the observed landscape.

The computer produces electrical signals for moving and varying the brightness of the spot, from information produced either by detectors or by manual settings, in order to allow at least the gunner and, if required, each member of the gun crew to see the trajectory of the same projectile in each of their aiming devices. This information includes data concerning the definition of the terrain and the characteristics of the target, as well as the orientation of the gun with respect to a selected reference, and in particular a reference line of sight between the firing instrument and the observed target, and the distance between this instrument and the target. These reference data may be in part determined by the instructor in his aiming device.

The control unit is used for feeding the computer with ballistic data for the firing to be performed (nature of the round, temperature of the round to be fired, etc..), meteorological data (atmospheric temperature and pressure, longitudinal and cross winds, etc.), and target distance as well as various other data required for firing.

The simulated projectile trajectory computed by computer 1 takes into account various data characterizing firing conditions, the target and its position with respect to the firing instrument, and also the predetermined terrain data simulating the firing terrain and recorded in the computer by the instructor before the instant of aiming.

The various data and in particular the reference data provided by the instructor can be affected by random variations selected arbitrarily by the computer from ranges of error inherent in firing and aiming conditions, in order to increase the realism of the firing exercice.

A prior art simulating device somewhat similar to the instant invention utilized for outdoor training in the operation of line-of-sight guided missles is known as the DX-43 EXOSIMULATOR manufactured by Giravions Dorand of France. In the technical manual of the DX-43 EXOSIMULATOR, a C-S.6 special purpose analog computer is utilized. The analog computer therein described utilizes three computing channels to determine at every instant the motions of the simulated missle in time and in space. The information generated by the computer is transmitted to the servo mechanisms and to the light source of an optical unit so as to control the brilliance and motion of the light spot which simulates the missle. On pages II-1 to II-10 an optical unit with an aiming device is described which may be utilized in the method and system of the present invention. Plates 21 and 24 of the technical manual disclose a detailed embodiment of the optical units, while plate 28 illustrates a schematic block diagram of a simulator which discloses appropriate connections between the optical unit and the analog computer. An electrical diagram of the computer is included at the end of the manual and serves as exemplary of a prior art computer programmable in accordance with the instant inventive technique. As will become more clear hereinafter, the DX-43 EXOSIMULATOR differs from the instant inventive technique in that in the former device the displacement of the light spot ceases as soon as the fictitious distance traveled by the missle attains the operator-to-target distance corresponding to a preselected firing time, whereas in the instant invention displacement of the spot ceases when the spot trajectory intersects the plane or planes which define the terrain and have been pre-recorded into the computer memory. This distinction allows the observation of the point of impact of the fired projectiles with the ground in order to provide more efficient training by allowing corrections in firing angles and the like to be made based upon observed impacts with actual terrain. The method of computing the point of impact of the projectile with the terrain will be explained in more detail hereinafter.

Figure 2:
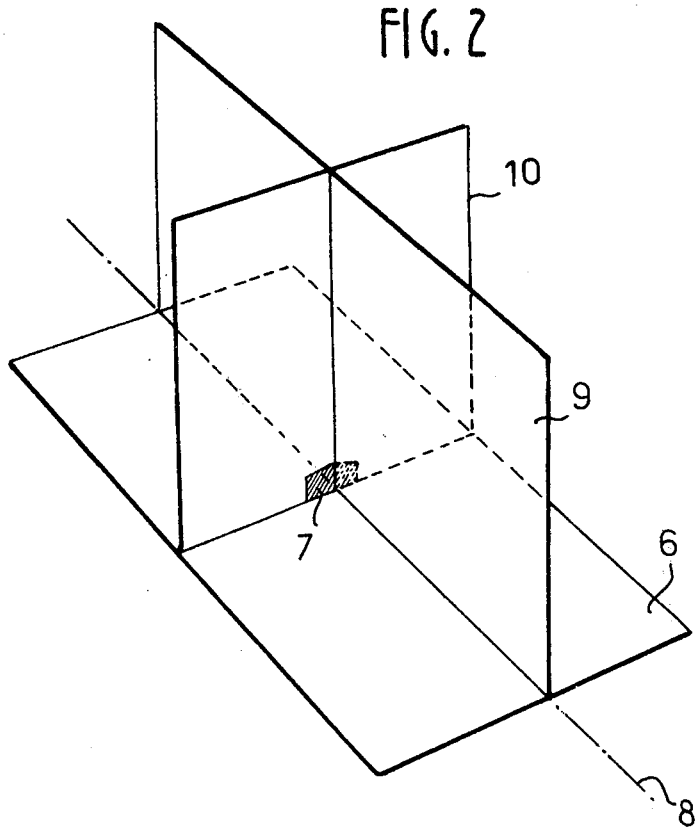
FIG. 2 illustrates the definition of the terrain surrounding the target, when only one ground plane is prerecorded.

In the simplest case, the ground surrounding the target is represented by a single ground plane, which, as shown in FIG. 2, is preferably a plane 6 containing the visible base of the target 7, as seen by the gunner. This plane is such that it does not contain the vertical line through the target. It can be horizontal or with its line of greatest slope parallel to the line of sight 8. It is limited by boundaries to the left and right of the target and behind and in front of the target. In the computer memory, it is associated with the firing plane 9, a vertical plane containing the line of sight 8 and defined by this line, and plane 10, practically vertical, perpendicular to the line of sight and containing the target, which is defined by the measured distance of the target. Other target data may be recorded for defining in particular its apparent outline in plane 10 in a more or less approximate manner.

FIGS. 3A, 3B and 4 illustrate a preferred embodiment of the invention, where the terrain is represented schematically by a succession of three planes $\pi_1$, $\pi_2$, and $\pi_3$, perpendicular to the vertical plane containing the line of sight (and the gun axis), of different slopes, located in front of, around and behind the target respectively.

The number of such planes may be higher than three.

The characteristics of these planes are estimated by the instructor and fed into the computer memory in the form of three angles of slope $P_1$, and $P_2$ and $P_3$, and two distances, $d_{c1}$ and $d_{c2}$, of their lines of intersection from the gun, in the case of three planes.

The simplified terrain obtained in this manner is limited in range and laterally, and these data are also fed into the computer in the form of two distances $d_{T1}$ and $d_{T2}$, and an angle $\theta_T$.

Target 12 placed on this terrain by the instructor is defined for a given position of the gun by its distance $D_c$ from the gun, its elevation and bearing angles with respect to the gun axis, and by the dimensions of its apparent outline.

These data, together with the gun elevation and train angles, are fed into the computer at least in part by the instructor before firing occurs.

Firing then takes place as for a conventional simulator. The crew aims the gun at the target, sets the range as measured or estimated, and fires.

The computer then determines the simulated projectile trajectory with respect to the simplified terrain.

If the simulated projectile hits the ground at a point visible to the gunner, its impact is indicated by a simulated explosion (impact *d*).

If the projectile trajectory disappears behind a rise in the ground, the luminous spot is automatically extinguished.

The instructor can also cause the spot to disappear (by depressing a button, for example) when impact occurs in a visible region of the terrain, but with local masking (trees, for example), not recorded in the computer memory.

If the simulated projectile meets the vertical plane containing the target and perpendicular to the line of sight, two cases are possible:

If the projectile passes through this vertical plane outside of the apparent outline of the target, ground impact behind the target is indicated by a simulated explosion (impacts *a* and *b*), unless these points are masked by the terrain or by the target itself, causing the spot to disappear as described above (impact *c*);

If the projectile passes through this vertical plane within the apparent outline of the target, a simulated explosion indicates that the target has been hit (impact *e*).

Summarizing, the following cases are illustrated by the impact points shown in FIGS. 3B and 4:

a: long shot to the left, impact seen;

b: long shot in the correct direction, impact seen;

c: long shot in the correct direction, impact not seen;

d: short shot to the right, impact seen;

e: shot on target, impact seen.

It is obviously possible to memorize several simplified terrains of the types described above, and to select several target locations from which the instructor can make his choice at the time of firing.

If a computer having greater memory capacity is used, it is possible, according to the invention, to prerecord and store in memory the complete configuration of any real firing range, so that no instructor intervention is required for estimating the terrain, and allows complete automation of the process.

The gun can then be fired in any direction, provided that the projectile trajectory is contained within the area of terrain stored in memory.

Within these same limits, the position of the gun can vary, and it is sufficient to provide the computer before firing with the coordinates of the gun and target (and their velocities, if required) so that all terrain features or masks are automatically accounted for by the computer.

According to the invention, the device also allows moving targets to be fired at. For this purpose, it is sufficient to complete target data by feeding the cross and radial velocities of the target into the computer by means of appropriate controls.

Impact with the ground or target can be simulated by brightening the luminous spots in the optical units, this brightening being variable in intensity and/or duration, to differentiate between hits on the target (simulated impacts on the target) and misses (simulated impacts on the ground).

In the present embodiment the terrain is defined by the following parameters:

a. the elevation angle of the first crest of the terrain, i.e., the line of intersection of planes $\pi 1$ and $\pi 2$ of FIG. 3A;

b. the distance on the second crest from the gun, *dc2*; and c. the three angles of slope of the three planes $P_1$, $P_2$, and $P_3$.

The terrain is thus defined here as three successive planes, but more than three planes could be used if desired.

The first plane $\pi 1$ is perpendicular to the vertical plane through the gun axis just before firing and has an angle of slope $P_1$ equivalent to the evaluated mean slope of the terrain in front of the target. It is limited by the first crest line elevation angle C1 as the upper elevation angle and either by the sight field or a value corresponding to the minimum firing distance (for instance 500 meters) as the lower elevation angle.

The second plane $\pi 2$ is a plane perpendicular to the vertical plane through the gun axis having an angle of slope $P_2$ corresponding to the evaluated means slope of the terrain around the target. It is limited by the first crest line elevation angle C1 as the lower elevation angle and by the elevation angle of the line of change of slope at distance dc2 as the upper sight angle.

The third plane $\pi 3$ is a plane perpendicular to the plane through the gun axis having an angle of slope $P_3$ corresponding to the evaluated mean slope of the terrain behind the target. It extends from distance dc2 (sight angle of the line of intersection of $\pi 2$ and $\pi 3$) to a distance corresponding to a maximum firing distance (for instance 3,000 meters).

The target is defined by the following parameters:

d. the distance of the target from the gun mouth (Dc);

e. the elevation angle of the target base with respect to the gun axis just before firing ($t = 0$); and f. the angle coordinates of the target's apparent outline (height and width), thus determining an equivalent rectangular outline.

Furthermore, the projectile trajectory is characterized at each moment of the projectile flight by its angle coordinates (i.e., elevation and bearing angles) with respect to the reference aiming axis.

Parameters *b, c, d* abovenoted are introduced manually into the computer as voltage signals through potentiometers. Their values are evaluated or measured. For instance, slopes may be measured from maps and distances may be measured by telemetry.

Parameters a, e and f abovenoted are introduced on the site by directly aiming at the first crest of the terrain and at the four sides of the target successively. Aiming is effected with the same light spot as that which is later used to simulate the projectile. To control the spot for aiming, an auxiliary control stick is used. For each aiming, the parameters are registered by the computer as reference voltage signals depending on the corresponding angular displacements of the spot. These reference signals are thus produced by the same means as the projectile trajectory, i.e. the servo control means of the light spot, which ensures a common reference between the projectile trajectory and the terrain and target parameters.

In the computer, the reference terrain and target data thus obtained are used to compare, for each point along the trajectory, the terrain elevation and the projectile elevation. When the distance of the projectile becomes equal to that of the target, the projectile coordinates are compared with the target coordinates.

The projectile, terrain and target are considered in a common coordinates system, wherein the ligh spot position on the projectile trajectory is defined by the elevation and bearing angles $\alpha N$ and $\beta N$. The terrain and target data are expressed in this system as stated above.

As a function of the displays of terrain and target, determined by the instructor, the computer will execute a program which determines, for each position of the projectile in time, the relative position of the terrain, according to the flow diagram in FIG. 9. To increase precision, the terrain is determined on firing the projectile. As seen in FIG. 9, the program is carried out in two phases as follows.

First phase

In a fraction of a second, the computer determines the terrain (see FIG. 10) going up the terrain from the target with a slope corresponding to the display of the second slope (slope 2) up to a distance corresponding to the lie of the first crest, then with a slope corresponding to the display of the first slope up to the instant $t_n$ where the distance of the corresponding point on the terrain is equal to the distance of the projectile at the instant considered. At this instant, the lie of the simulated terrain is $S_{tn}$ (FIG. 10).

Second phase

The clock of the computer determines the increments of time $\Delta t$, at the end of which the lie of the terrain is modified. Time $\Delta t$ depends on the round (anti-tank or anti-personnel) corresponding to a progression of the projectile of 2 meters.

For each such progression of the projectile, a fresh terrain lie is computed from the following data:

Slope $P_1$ if the first crest lie has not yet been reached;

Slope $P_2$ if the first crest lie has been reached but if the distance of the projectile is less that the second crest distance; and Slope $P_3$ if the distance of the projectile is greater than the distance of the line of change in slope behind the target.

Intersection of the Simulated Trajectory of the Projectile with the Target and the Terrain The fixed or mobile target situated on the terrain is defined by the angular coordinates of each straight line connecting the respective bottom, top, left hand and right hand position of the target in a trihedral of reference of the trajectory. These various coordinates are:

$\alpha$ B (bottom)

$\alpha$ H (top)

$\beta$ G (left)

$\beta$ D (right)

When the distance of the simulated projectile is equal to the distance of the target, the elevation and bearing angles $\alpha_N$ and $\beta_N$ of the projectile are compared respectively with $\alpha_B$, $\alpha_H$ $\beta_G$, $\beta_D$.

There will be an explosion corresponding to a hit on target if the following conditions are met:

$$\alpha B < \alpha N < \alpha H \quad (1)$$

$$\beta G < \beta N < \beta D \quad (2).$$

The explosion is simulated by a superintensity of the light spot representing the projectile, followed, after a fraction of a second of extinction, by a brilliant flash lasting about 0.15 sec.

After the explosion, the appearance of smoke of varying intensity terminates the firing sequence.

If only condition (2) above is met, the projectile continues its trajectory up to the moment when $$\alpha_N = \alpha_H$$

At this moment the target conceals the projectile and the end of the trajectory is not visualized by an automatic command. Likewise, if $\alpha_N < \alpha_{SCI}$ and the slope of the terrain in course, corresponds to the second slope, the projectile is concealed by the first crest. Under these conditions, the automatic command extinguishes the trajectory.

Moreover, a manual command allows carrying out the same operation when there occurs a natural mask of the terrain (such as a thicket, pond, etc.).

The lie of the simulated projectile is continuously compared with the lie of the simulated terrain. If the conditions of intersection of the trajectory of the projectile with the target are not embodied, there will be an impact on the terrain when the lie of the projectile becomes equal to the lie of the terrain.

The explosion here is simulated as is the case with target impact by a superintensity of the light spot representing the projectile, followed a fraction of a second later by a smoke of varying intensity terminating the sequence of the shot.

Referring now to FIG. 11, an exemplary circuit is illustrated for determining the lie of the terrain at an instant in time $t_n$ in the trajectory of the projectile. The circuitry is seen to comprise a divider 50, a muliplier 60, and an adder 70. Interposed between multiplier 60 and adder 70 is a switch S1. The output of adder 70 is fed back as one input thereto, the voltage therefrom being stored on capacitor C1. The inputs to the various functional block diagrams illustrated in FIG. 11 may be defined according to the following parameters:

D = the distance of the projectile relative to the shooter;

$P_i$ = the slope of the terrain above which the representative point of the trajectory is found; and $\Delta x$ = the distance traveled by the projectile between the instant of time $t_n$ and $t_{n+1}$.

Accordingly, the circuitry set forth in FIG. 11 effectively performs the following calculation:

Lie of terrain $(t_n)$ = lie of terrain $(t_{n-1})$ + $Pi(\Delta x/D)$

In order to determine the elements of the terrain (lie and distance) at instant $t_1$ from the start of the comparison with the trajectory of the target, a preliminary calculation is made, going up the terrain from the foot of the target. Under these conditions, the sequence is carried out at a high frequency independent of the true time. This method has the advantage of making the terrain coincide with the foot of the target.

Refering to FIG. 12, $D_{IC}$ is determined by the formula:

$$D_{IC} = d_{target}\left(1 - \frac{S_{terrain\ 1st\ crest} - S_{terrain\ base\ of\ target}}{P_2}\right)$$

with $d_{target}$ = distance of foot of target and P = slope of the portion of terrain considered.

In the case of an analog computer, the formulas are utilized in electronic circuits by having voltages correspond to the various parameters defined in the mathematical formulas.

In a numerical general purpose digital computer, a program in machine language compatible with the universal computer used, defines, step by step, the various mathematical operations necessary to process all of the data.

In order to improve further the realism of impact simulation, slides or cine-films made during real firings may be used.

FIG. 5 schematically illustrates an optical unit allowing such simulation. A semi-reflecting mirror 14 is placed on the optical axis of eyepiece 13 at 45° to this axis, enabling the real landscape and target to be seen through the eyepiece as well as a collimated luminous spot produced by lens 15 from the light source 16 and reflected by a servo-controlled mirror 22, whose angular motion determines the spot movement. The image of the light source itself is reflected to lens 15 by mirror 17, inclined at 45° to the optical axis and mounted on a pivot 18, thereby enabling the image of source 16 to be replaced by images on screens or of firing effects, different one from another and placed around the mirror in positions 19, 20 and 21 in the figure, by the rotation of pivot 18.

Superimposition on the landscape seen through the aiming device can, as a variant, be performed by projecting images of firing effects into the field of view of the aiming device in an intermittent manner, at a sufficiently high rate to produce in the eye of the observer superimposition of these images and the landscape. This may be achieved by placing a shutter system in the optical path of the eyepiece, enabling the landscape and projected views to be seen alternately. The projected views may be those of fixed images or the successive frames of a cine-film.

Several types of views or cine-films can be provided to differentiate between the effects corresponding to target impact, or ground impact, and to an impact seen by the gunner or masked by an obstacle, in particular the target.

The choice of impact corresponding to the gunner's aim can be made automatically by the computer or controlled manually by the instructor.

By means of a control, the instructor can display the gunner's aim in his aiming device, corrected by the computer as a function of the preselected simulated firing conditions, enabling him to know the result of the firing and the trajectory, even before firing and the simulation in the gunner's aiming device, and consequently to determine partially this simulation by introducing the corresponding effects of impact beforehand.

Special effects can also be provided in the system for improving firing simulation. Thus, defocussing of the aiming devices can be produced at the instant of firing to simulate smoke.

The simulation of "waving" (optical distortion due to hot air) is obtained as shown in FIG. 6 by placing a moving transparent glass 23 having flatness and parallelism defects in the optical path of aiming device 13, the optical unit being otherwise similar to that in FIG. 5. Glass 23 is in the form of a circular sector mounted on a rotating shaft, which is offset with respect to the field of view defined by circle 24.

Figure 7:
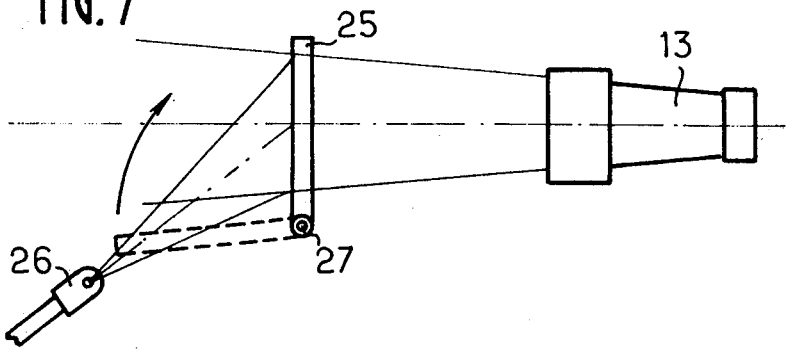

As shown in FIG. 7, a frosted glass 25 illuminated by a luminous source 26 and hinged on axis 27 for removing this glass from the optical path, can be placed in the optical path of the aiming device 13. This glass simulates the effect of dazzling.

Figure 8:
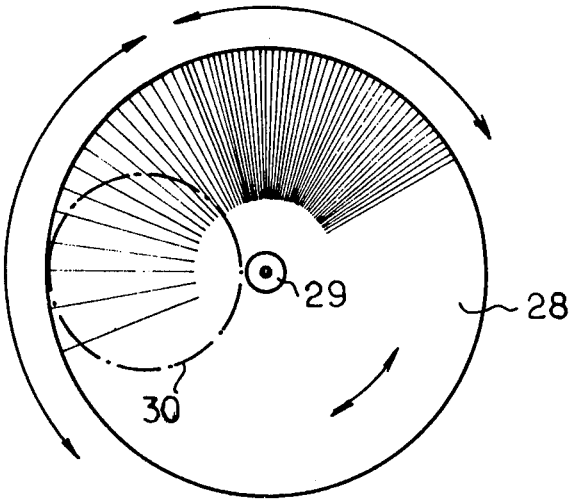

In order to simulate greater or lesser smoke density, masking the luminous spot that represents the projectile flare during its trajectory, a disc similar to disc 28 in FIG. 8 can also be used, this disc being mounted on a shaft 29, offset with respect to the field of view 30, and having several more or less clear or transparent sectors.

It should be understood that the invention is in no way limited by the practical means described and illustrated, and is capable of many variants, known to persons of the art, in accordance with the applications considered, and still nevertheless remaining within the scope of the invention. The invention can also be applied not only to ballistic projectiles, but also to all types of preguided, teleguided, autoguided or para-ballistic projectiles.

What is claimed is:

1. A method of gunnery training including the simulation of the firing of a projectile from a gun up to and including the point of impact of the fired projectile which comprises optically representing the trajectory of said projectile as a function of the aiming of the gun and of reference data which includes a reference line of sight from the gun to the target and the distance to the target from the gun; determining the point of impact of said projectile as defined by its simulated intersection with simulated terrain data which defines at least three ground planes perpendicular to the vertical plane containing the line of sight, said ground planes located respectively around the target, in front of the target, and behind the target, with respect to said gun; and providing an optical indication of said point of impact, with said optical indication being shown either as a visible or hidden impact depending on the position of the point of impact on the ground planes with respect to the target outline.

2. The method according to claim 1, wherein for the simulation, account is taken of prerecorded target data defining at least the approximate outline of the target in the plane perpendicular to the line of sight.

3. The method according to claim 1, wherein the simulated trajectory and simulated impact are no longer displayed when this trajectory passes behind the target or a visible ground obstacle.

4. The method according to claim 1, wherein the trajectory is indicated in the aiming device of an instructor at the same time as in the aiming device of the firer, such that the instructor may intervene during the simulated firing sequence to cancel the display of ground impact.

5. The method according to claim 1, wherein the trajectory is displayed at least partially in the aiming device of an instructor, before simulation in the aiming device of the firer, and that the instructor determines in part this simulation.

6. The method according to claim 1, wherein predetermined special firing effects are introduced into the simulation, which are displayed at least in the field of view of the aiming device of the firer, by superimposition on the observed landscape, notably by the projection of views or cine-films of real firing effects, and selected as a function of the simulated firing trajectory either automatically or by the instructor, notably to display the simulated impact in different ways, depending on whether it is on the target or with the ground, and at a point seen by or hidden from the firer.

7. The method according to claim 1, wherein random variations are applied to at least some of the reference, target or terrain data.

8. A firing training system for carrying out the method acording to claim 1, said system comprising a simulated firing computer in which are recorded the terrain data, and at least one optical unit for simulating in at least the aiming device of the firer the simulated firing determined by the computer as a function of the firer's aim.

9. A system according to claim 8, further including at least one aiming device and means of connection to the computer, for introducing reference data determined by an instructor in this aiming device.

10. A system according to claim 8, further including means for displaying the simulated firing in the aiming device of an instructor at the same time as in the aiming device of the firer.

11. A system according to claim 8, further including means for displaying the simulated firing to an instructor before simulation in the aiming device of the firer.

12. A system according to claim 8, wherein the simulator includes means for displaying superimposed on the landscape in at least the aiming device of the firer special simulation effects controlled automatically by the computer or by instructor intervention.

13. A method of gunnery training including the simulation of the firing of a projectile from a gun up to and including the point of impact of the fired projectile which comprises optically representing the trajectory of said projectile as a function of the aiming of the gun and of reference data which includes a reference line of sight from the gun to the target and the distance from the gun to the target; said reference date including simulated terrain data which defines at least one ground plane which is distinct from the plane perpendicular to the vertical plane containing the line of sight, which ground plane is also distinct from the plane perpendicular to the line of sight at said target distance; determining said simulated projectile trajectory up to said point of impact from said reference data and from the aim of said gun upon the firing of said simulated projectile; and providing an optical indication of said point of impact, with said optical indication being shown either as a visible or hidden impact depending on the position of the point of impact on the ground plane with respect to the target outline.

14. The method according to claim 13, wherein said simulated point of impact with the ground is defined by the intersection of said simulated projectile trajectory and said ground plane away from said target, and wherein a simulated impact with the ground is indicated differently from a simulated impact on said target.

15. In a gunnery training system capable of providing training by simulated firing of a projectile onto an actual target and landscape which includes optical means for signting the target and surrounding terrain and for producing a luminous spot indicative of the simulated flight of said projectile, which spot is superimposed by said optical means on said surrounding terrain, computer means for producing electrical signals for controlling the position and intensity of said luminous spot according to prerecorded data, control means for feeding ballistic data to said computer means, the method of providing an optical indication of the actual point of impact of said simulated projectile on said target or on said surrounding terrain, which comprises the steps of providing simulated terrain data into said computer means which defines at least three ground planes perpendicular to the vertical plane containing the line of sight to said target, said three ground planes located respectively around the target, in front of the target, and behind the target; and providing a visual indication in said optical means from said computer means as to the precise point at which the trajectory of said simulated projectile intersects one of said three ground planes whereby corrective measures may be taken by the gunner in accordance with said visual indication, said visual indication being shown either as a visible or hidden indication depending on the position of the point of impact on the ground planes with respect to the target outline.

* * * * *